United States Patent [19]

McCormack

[11] 3,968,973

[45] July 13, 1976

[54] TOE STOP FOR ROLLER SKATES

[75] Inventor: Darrell W. McCormack, Tulsa, Okla.

[73] Assignee: Fo-Mac, Inc., Tulsa, Okla.

[22] Filed: Jan. 6, 1975

[21] Appl. No.: 539,023

[52] U.S. Cl. ..... 280/11.2
[51] Int. Cl.[2] ..... A63C 17/14
[58] Field of Search ..... 280/11.2, 11.21

[56] References Cited

UNITED STATES PATENTS

| | | | |
|---|---|---|---|
| 2,485,147 | 10/1949 | Fowlkes | 280/11.2 |
| 2,566,747 | 9/1951 | Rice | 280/11.2 |
| 2,631,861 | 3/1953 | Daniska | 280/11.2 |
| 2,941,812 | 6/1960 | Reynolds | 280/11.2 |
| 3,016,246 | 1/1962 | Ware | 280/11.2 |

*Primary Examiner*—M. H. Wood, Jr.
*Assistant Examiner*—Milton L. Smith
*Attorney, Agent, or Firm*—Head, Johnson & Chafin

[57] ABSTRACT

A toe stop for roller skates, said toe stop including first and second flat surfaces on the bottom thereof disposed at an angle with respect to each other and meeting at a common juncture therebetween, the transverse dimension of one flat surface being less than the transverse dimension of the other flat surface whereby one flat surface is of a greater area than the other flat surface, and the lesser of said flat surface being the leading portion of the bottom of the toe stop when installed on a roller skate.

2 Claims, 5 Drawing Figures

TOE STOP FOR ROLLER SKATES

BACKGROUND OF THE INVENTION

1. Field of the Invention

This invention relates to improvements in toe stops for roller skates and more particularly, but not by way of limitation, to a toe stop having a bottom surface comprising two flat surfaces having the planes thereof angularly disposed with respect to one another.

2. Description of the Prior Art

Toe stops are in widespread use on roller skates, and particularly in use by professional skaters, and the like, for facilitating starting and stopping while skating. For example, the toe stop shown in the G. V. Fowlkes U.S. Pat. No. 2,485,147, issued in October 1949, has been widely used by roller skaters in the past and comprises a toe element having a bottom surface for engaging the ground to facilitate stopping. The Reynolds U.S. Pat. No. 2,941,812, issued June 21, 1960, also shows a toe stop for facilitating stopping and the like and includes a bottom having three surfaces at different angles with respect to each other. However, the toe stop shown in the Fowlkes patent, which was very popular with skaters for many years, evolved into another very popular and widely used toe stop, commonly known in the industry as the Fowlkes toe stop, even though the item was not patented. The evolved Fowlkes-type toe stop, which has been manufactured by Fo-Mac, Inc. for many years, includes a bottom surface having two flat portions disposed at an angle with respect to one another. One of the flat surfaces of this evolved Fowlkes-type toe stop, manufactured by Fo-Mac, Inc., is of a transverse dimension smaller than the transverse dimension of the other flat surface, with the leading portion of the bottom of the toe stop being the greater of the flat surfaces. In use, the smaller of the flat surfaces is the surface which initially engages the ground during stopping or starting, or the like, and the larger or greater flat surface only engages the ground when the skate is tipped or rolled over at a greater forward angle. Some skaters using the evolved Fowlkes-type toe stop manufactured by Fo-Mac, Inc. have found that initial engagement of the ground with the larger flat surface is more efficient than the initial engagement of the ground with the lesser flat surface. Consequently, many users of the toe stop manufactured by Fo-Mac, Inc. have reversed the position or orientation of the toe stop on the skate in order that the lesser of the two flat surfaces will be the leading portion of the bottom of the toe stop and the greater portion will initially engage the ground. This has disadvantages, however, in that the means for connection of the toe stop with the skate normally includes either a plate means engagable with the toe plate of the skate, or a threaded stud disposed at an angle with respect to the lesser flat surface of the toe stop for engagement with a complementary element provided on the skate. The reversal of the toe stop requires a modification of the complementary elements of the skate in order to install the toe stop on the skate.

SUMMARY OF THE INVENTION

The present invention contemplates a novel toe stop particularly designed and constructed for overcoming the above disadvantages. The novel toe stop comprises the usual main body portion generally similar to that known in the industry as the aforementioned Fowlkes toe stop and is provided with two flat surfaces on the bottom thereof conterminous with a common line of junction therebetween. One of the flat surfaces is of a transverse dimension less than the transverse dimension of the other flat surface, providing one flat surface having a larger surface area than the other flat surface. The lesser flat surface is the leading surface of the bottom of the toe stop, and the main body is provided with the usual threaded stud disposed at the optimum angle with respect to the larger flat surface for securing the toe stop to the skate in a manner wherein the initial engagement for stopping, starting, or the like, is with the larger flat surface. Whereas the common line of juncture between the two flat bottom surfaces of the toe stop is initially molded or otherwise constructed whereby said juncture is a sharply defined line, during use of the toe stop, the material at the juncture becomes worn and the juncture between the two flat surfaces may become rounded. However, the initial construction of the toe stop, including the line of sharp definition between the two flat surfaces, provides an additional quantity of material at the juncture for prolonging the useful life of the toe stop during use thereof.

DESCRIPTION OF THE PREFERRED EMBODIMENT

Figure 1:
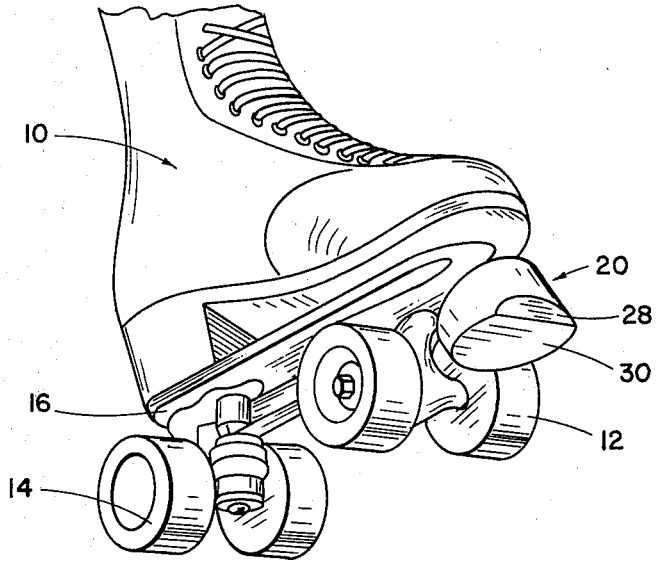
FIG. 1 is a perspective view of a typical roller skate provided with a toe stop embodying the invention.
Figure 2:
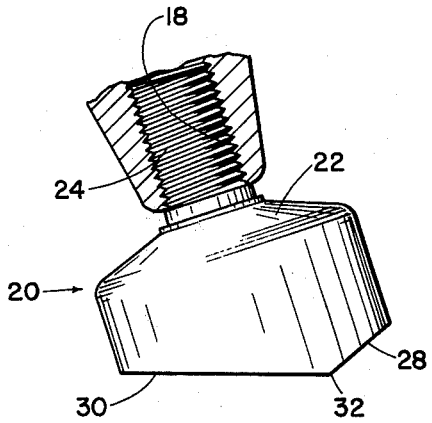
FIG. 2 is a side elevational view of a toe stop embodying the invention, with a portion of the socket means of the skate plate being depicted in section for purposes of illustration.
Figure 3:
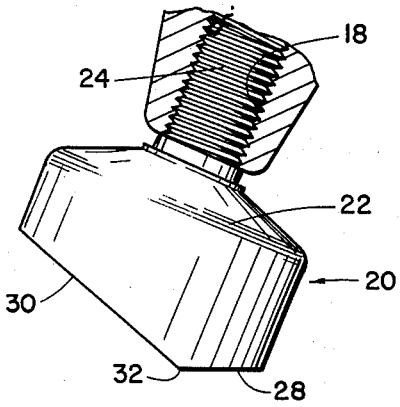
FIG. 3 is a view similar to FIG. 2 depicting a toe stop embodying the invention in a different position.
Figure 4:
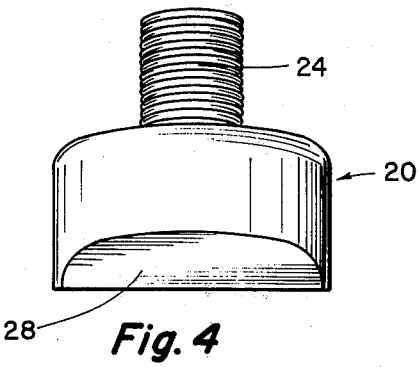
FIG. 4 is a front elevational view of a toe stop embodying the invention.

Referring to the drawings in detail, reference character 10 generally indicates the usual roller skate which may be of any suitable well known type normally comprising a pair of front wheels 12 and a pair of rear wheels 14 suitably journalled on the usual skate plate 16 in any well known manner. The skate plate 16 is normally provided with a threaded stud socket, such as shown at 18, extending downwardly and forwardly from the leading portion of the skate plate 16, usually spaced forwardly of the front wheels 12, for receiving a suitable toe stop, such as the toe stop 20, therein. The threaded socket 18 is usually provided with suitable clamp means (not shown) to retain the stud in place once it is positioned on the skate plate 16, as will be hereinafter set forth in detail.

Figure 5:
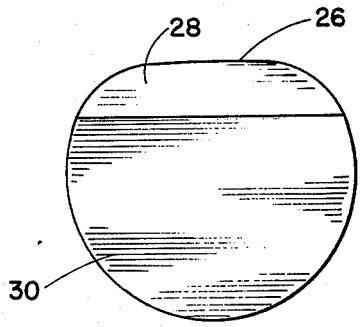
FIG. 5 is a bottom view of a toe stop embodying the invention.

The toe stop 20 comprises a main body portion 22 constructed from any suitable substantially resilient composition or material, as is well known, and a suitable stud member 24 is secured to the body 22 in the usual or well known manner (not shown) and extends outwardly from the upper surface of the body 22 as viewed in the drawings for threaded engagement with the stud socket 18. The outer periphery of the body 20 is substantially arcuate with a substantially straight chord portion 26 intercepting a relatively short portion thereof as particularly shown in FIG. 5. The bottom or exposed surface of the body 22 is provided with first and second flat surfaces 28 and 30, respectively. The first flat surface 28 is conterminous with the flat chord 26, which is the leading portion of the toe stop 20, and is of a transverse dimension less than the transverse dimension of the flat surface 30, as clearly shown in the drawings. The surfaces 28 and 30 are angularly disposed with respect to each other, and are conterminous at a sharply defined line of juncture 32. During use of the toe stop 20, the material at the juncture 32 may wear whereby the juncture becomes substantially rounded, but the initial provision of the sharply defined juncture 32 between the flat surfaces 38 and 30 assures a sufficient quantity of material for withstanding substantial wear during use.

The stud 24 is disposed at an optimum angle with respect to the plane of the flat surface 30, and this angle is preferably substantially identical with the angular relation between the connecting means and lesser flat surface of the toe stop of the aforementioned evolved Fowlkes-type. This relationship is old and well known in toe stops of this type, and has been in use for many years.

When the toe stop 20 is installed on the skate 10, the stud member 24 is threadedly engaged with the threaded socket 18 in the usual manner. It is the normal practice to thread the stud 24 into the socket 18 a sufficient distance to place the bottom of the stop 20 at the desired spaced distance from the floor or ground when the wheels 12 and 14 are resting on the floor. When the toe stop 20 has been properly adjusted on the plate 10 whereby the chord member 26 is disposed forwardly on the skate 10, the usual clamping means (not shown) normally provided in conjunction with the socket 18 is utilized for securely clamping the stud 24 in the socket 18.

With the toe stop 20 thus secured on the skate plate 10, the skater may utilize the skates 10 in the usual manner, and when starting or stopping, as required in many competitive sports, and the like, the slight forward tipping of the skate 10 will cause the greater or larger flat surface 30 to initially engage the ground for providing an efficient starting, stopping, or the like. A continued forward tipping of the skate 10 will bring the lesser flat surface 28 into engagement with the ground under those conditions which require such engagement.

From the foregoing it will be apparent that the present invention provides a novel toe stop for roller skates which is particularly designed and constructed for providing a relatively large flat surface for initial engagement with the ground during starting, stopping, or the like, while skating, and a lesser flat surface for subsequent engagement with the ground when required. The toe stop comprises a main body portion having a bottom surface provided with two conterminous flat surfaces, one of said flat surface being of a greater area than the other of said flat surfaces. The toe stop is orientated on the skate in such a manner that the lesser of the flat surfaces is forwardly disposed with respect to the greater of said flat surfaces in order to assure that the larger flat surface will initially engage the ground for more efficient use of the toe stop. The novel toe stop is simple and efficient in use and economical and durable in construction.

Whereas the present invention has been described in particular relation to the drawings attached hereto, it should be understood that other and further modifications, apart from those shown or suggested herein, may be made within the spirit and scope of this invention.

What is claimed is:

1. A toe stop for roller skates comprising a main body portion having a bottom surface including two flat surfaces disposed at angles with respect to each other, one of said flat surfaces having a lesser exposed surface area than the other of said flat surfaces, and means carried by the main body portion for securing the toe stop to the roller skate with a lesser flat surface being orientated forwardly on the skate, and wherein the outer periphery of the main body portion is substantially arcuate but having a relatively short straight chord portion intersecting the arcuate periphery at the forward portion of the toe stop conterminous with the lesser flat surface.

2. A toe stop for roller skates comprising a main body portion having a bottom surface including two flat ground engaging surfaces disposed at angles with respect to each other, one of said flat surfaces having a lesser exposed ground engaging surface area than the other of said flat ground engaging surface; means carried by the main body portion for securing the toe stop to the roller skate with the lesser flat ground engaging surface being orientated forwardly on the skate, and said last-mentioned means comprising a threaded stud having the longitudinal axis thereof angularly disposed with respect to the plane of the flat surface having the greater area whereby said greater area flat surface initially engages the ground upon any forward tipping of the skate.

* * * * *